US005078311A

United States Patent [19]

Taguchi et al.

[11] Patent Number: 5,078,311

[45] Date of Patent: Jan. 7, 1992

[54] DISPENSING CARTON FOR A ROLL FILM

[75] Inventors: Takashi Taguchi, Ohomiya; Yorio Takemura, Tokyo. both of Japan

[73] Assignee: Kureha Chemical Industry Company, Limited, Tokyo, Japan

[21] Appl. No.: 711,552

[22] Filed: May 20, 1991

Related U.S. Application Data

[63] Continuation of Ser. No. 380,976, Jul. 17, 1989, abandoned.

[30] Foreign Application Priority Data

Jul. 25, 1988 [JP] Japan ..... 63-186461

[51] Int. Cl.[5] ..... B65D 85/67

[52] U.S. Cl. ..... 225/43; 225/50; 225/91

[58] Field of Search ..... 225/43, 49, 50, 77, 225/91

[56] References Cited

U.S. PATENT DOCUMENTS

| | | | |
|---|---|---|---|
| 3,088,640 | 5/1963 | Kunsch | 225/91 |
| 3,542,268 | 11/1970 | Schramm | 225/91 |
| 4,458,570 | 7/1984 | Morrison | 225/91 |
| 4,646,956 | 3/1987 | Ruff et al. | 225/77 |
| 4,899,918 | 2/1990 | Oketani et al. | 225/43 |

FOREIGN PATENT DOCUMENTS

| | | | |
|---|---|---|---|
| 633138 | 12/1961 | Canada | 225/49 |
| 2618007 | 11/1977 | Fed. Rep. of Germany | 225/77 |
| 1550228 | 8/1979 | United Kingdom | 225/48 |

*Primary Examiner*—Hien H. Phan

*Attorney, Agent, or Firm*—Koda and Androlia

[57] ABSTRACT

A dispensing carton in which a film wound cylindrically is contained includes a bottom panel, a rear panel, a front panel, both side panels, a lid member which is hingedly joined to the rear panel, a front flange joined to an end of the lid member to overlap the front panel when said lid member is closed, and a cutter mounted along an end of the front flange. The front flange includes a convex edge including, for example, a V-shaped edge. A saw-tooth edge of the cutter mounted along the end of the front flange is arranged into a convex shape such as V-shape. A length from the tip of at least one tooth of the saw-tooth edge nearest to a base of the box to the bottom of a gullet adjacent to the tooth is longer than a length from the tip of other teeth to the bottom of gullets adjacent to the other teeth. When the film is pulled out of the carton and further pulled in the horizontal direction or twisted while being pulled, the tooth of the cutter nearest to the base of the box first cuts into the film. Then, when the film is further pulled, the cut of the film is extended along the arrangement of teeth of the saw-tooth edge so that film is cut easily and completely while keeping the film spread horizontally.

4 Claims, 9 Drawing Sheets

DISPENSING CARTON FOR A ROLL FILM

This is a continuation of application Ser. No. 380,976, filed July 17, 1989 now abandoned.

BACKGROUND OF THE INVENTION

The present invention relates to a dispensing carton which contains a roll film used to wrap foodstuffs and can cut the film to dispense it.

More particularly, the present invention concerns a dispensing carton for a roll film which can cut the film by a cutter exactly only by pulling out the film from the carton and further pulling it in the horizontal direction or twisting the carton slightly after pulled out the film in the horizontal direction.

Film used to wrap foodstuffs together with a tray on which the foodstuffs are put is wound into a roll and contained in a carton. The carton is provided with a cutter. The film pulled out from the carton is cut by the cutter to a desired length.

FIG. 11 is a perspective view showing a conventional dispensing carton for a roll film. A dispensing carton which is most analogous to the carton of FIG. 11 is disclosed in U.S. Pat. No. 4,307,828, for example.

In FIG. 11, numeral 1 denotes a dispensing carton formed into a rectangular parallelepiped. The carton 1 contains a film 30 wound about a core into a roll. A lid member 4 which covers an opening 3 of the carton 1 is joined to a rear panel 2 of the carton 1. The lid member 4 is formed at an end thereof with a flange 6 which overlaps a front panel 5. A metal cutter 7 is mounted to a tip of the flange 6. A tip of the cutter 7 is provided with a saw-tooth edge which is slightly protruded from the tip of the flange 6 and is arranged straight along the tip of the flange 6.

The cutting operation of the film in the conventional dispensing carton is now described in detail. For convenience of the description, the rectangular coordinates X, Y and Z are defined in the dispensing carton as shown in FIG. 12. The X-axis is a perpendicular axis to the rear panel 2 and the front panel 5 and the direction extending to the front panel 5 from the rear panel 2 is the positive direction of the X-axis while the direction extending to the rear panel 2 from the front panel 2 is the negative direction of the X-axis. The Y-axis is a perpendicular axis to side panels 8 and 9 and the direction extending to the side panel 9 from the side panel 8 is the positive direction of the Y-axis while the direction extending to the side panel 8 from the side panel 9 is the negative direction of the Y-axis. The Z-axis is the perpendicular direction to both of the X- and Y-axes and the direction extending to the opening 3 from the base 1*a* is the positive direction of the Z-axis while the direction extending to the base 1*a* from the opening 3 is the negative direction of the Z-axis.

The cutting operation in the conventional dispensing carton is described using the X, Y and Z axes defined above.

The dispensing carton is first held by the left hand and an end of the film 30 is then held by the right hand to pull out it in the positive direction of the X-axis in the X-Y plane. After the end of the film has been pulled out by a desired length as shown in FIG. 12, the corner of the film 30 near the position A shown in FIG. 12 is held by the right hand and is tensioned with a moderate tension T in the X-axis direction by both hands. A portion of the lid member 4 near the portion a shown in FIG. 12 is then depressed in the negative direction of the Z-axis by the left hand and at the same time the tension T given to the corner of the film near the portion A is slightly increased while the corner is slightly lifted in the positive direction of the Z-axis by the right hand. Consequently, an end of the film 30 is cut by a portion B of the cutter 7 and the film 30 is cut further cut along the cutter 7 in the negative direction of the Y-axis. The cut film is used to wrap foodstuffs put on a tray. However, the above cutting operation possesses the following drawbacks.

It is desirable that the tray is covered by the film 30 fully opened along the X-Y plane. However, actually, when the portion a or its vicinity of the lid member is depressed in the negative direction of the Z-axis and at the same time the tension T is slightly increased while the corner of the film is slightly lifted up in the positive direction of the Z-axis by the right hand, the depressing operation in the negative direction of the Z-axis and the lifting operation of the positive direction of the Z-axis are often exessive or the increased amount of the tension T is often exessive. In such a case, the cut film 30 can not be kept opened fully along the X-Y plane and hence the film 30 held by the right hand is wrinkled or intertwined to be hung down so that an area of the film enough to cover the tray can not be obtained.

It is an object of the present invention to provide a dispensing carton for a roll film in which the film pulled out therefrom can be cut smoothly and completely without wrinkle and intertwinement only by pulling out the film from the carton and further pulling it in the horizontal direction or twisting slightly the carton after pulled out the film in the horizontal direction without lifting the pulled film from the carton extremely.

It is another object of the present invention to provide a dispensing carton for a roll film in which the film can be cut while fully spread horizontally and a tray is covered by the cut film fully spread without wrinkle and intertwinement.

SUMMARY OF THE INVENTION

According to the present invention, a dispensing carton containing a film wound cylindrically comprises a bottom panel, a rear panel, a front panel, both side panels, a lid member joined hingedly to the rear panel, a front flange joined to an end of the lid member to overlap the front panel when the lid member is closed, and a cutting member provided along an end of the front flange. The end of the front flange is formed into a convex shape such as, for example, a V-shape and accordingly a saw-tooth edge of the cutting member which is lined up along the end of the front flange is also arranged to be protruded into a convex shape such as a V-shape. A length from the tip of at least one tooth of the saw-tooth edge nearest to a base of the box to the bottom of a gullet adjacent to the tooth is longer than a length from the tip of other teeth to the bottom of gullets adjacent to the other teeth. When the film is pulled out from the carton and is cut by the cutting member, the tooth positioned nearest to the base of said box first cuts into the film. When the film is further pulled, the portion cut by the tooth is extended along the saw-tooth edge of the cutting member and the film is smoothly and completely cut.

DETAILED DESCRIPTION OF PREFERRED EMBODIMENTS

Figure 1:
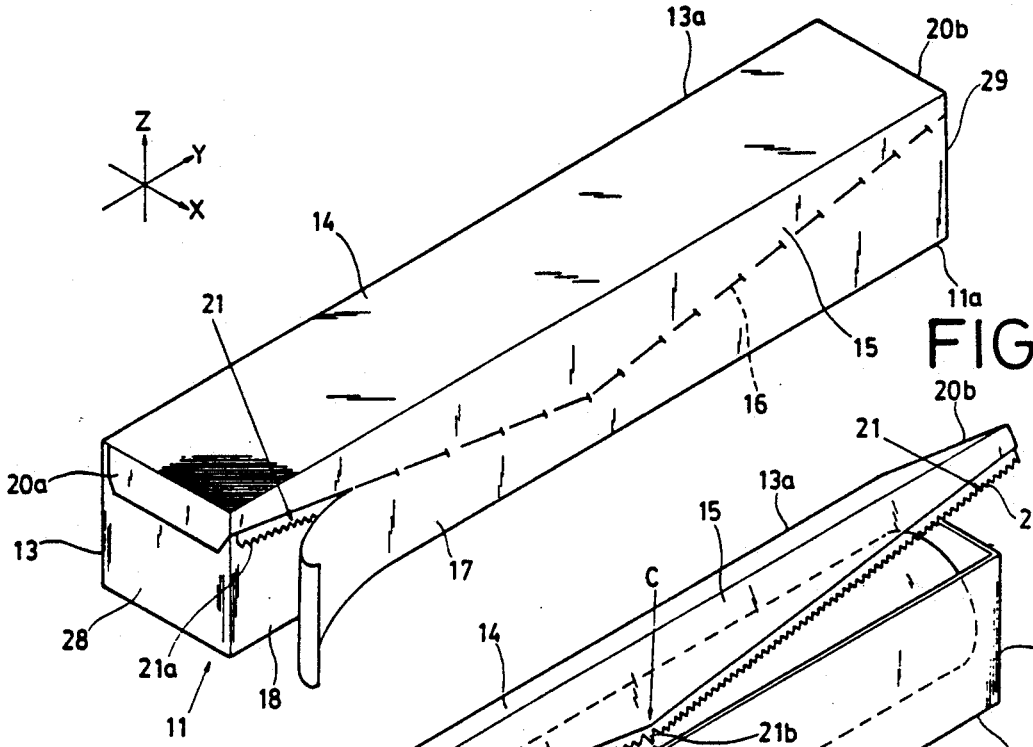
FIG. 1 is a perspective view of a dispensing carton, not opened, for a roll film according to the present invention.
Figure 2:
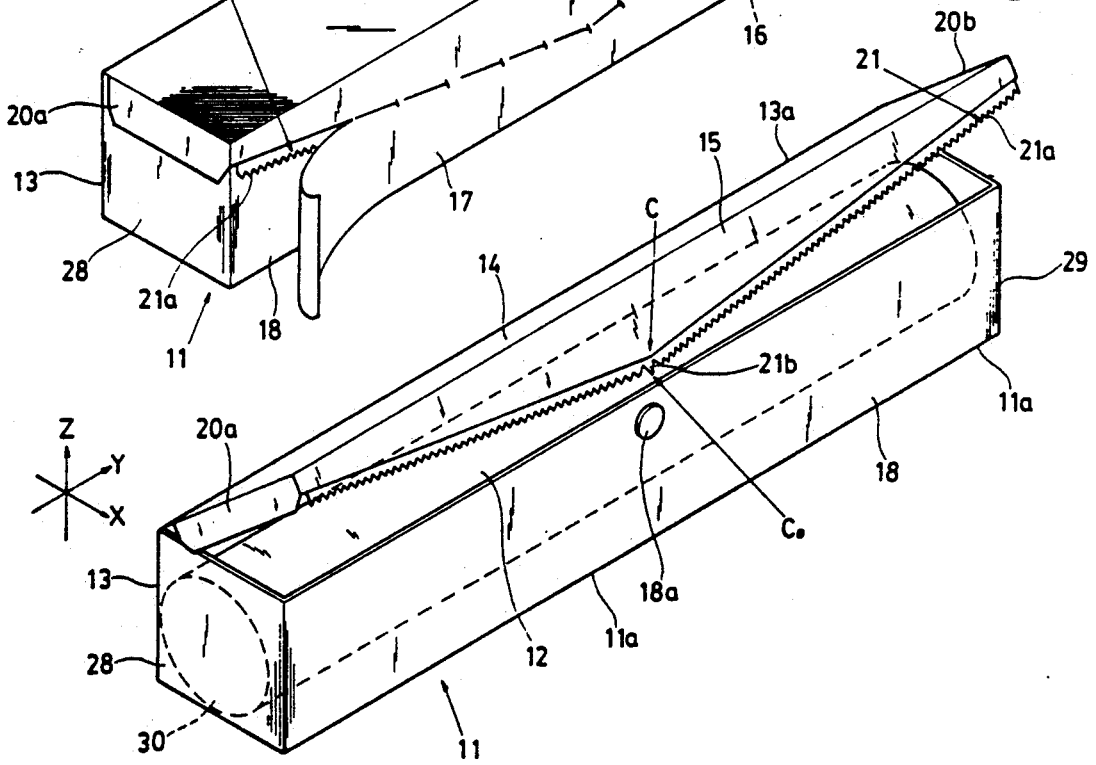
FIG. 2 is a perspective view showing a dispensing carton, which has been opened, for a roll film according to the present invention.
Figure 3:
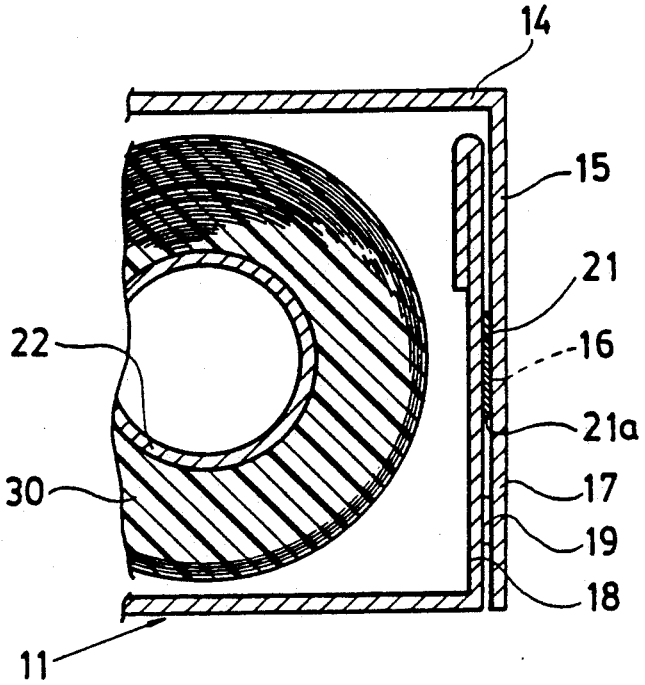
FIG. 3 is a sectional view showing a dispensing carton not opened.

Referring to FIGS. 1 and 2, there is shown a dispensing carton 11 manufactured of paper. The carton 11 includes a rear panel 13, a front panel 18, side panels 28 and 29 and a bottom panel, and is formed into a rectangular parallelepiped. The carton 11 includes an opening 12 formed in the upper portion thereof. A lid member 14 which covers the opening 12 is integrally joined to an upper end of the rear panel 13 of the carton 11. A front flange 15 and a tear strip 17 continuously provided to the front flange 15 are provided in a front end of the lid member 14. The front flange 15 and the tear strip 17 are separated by a line of perforation 16. Both sides of the lid member 14 is formed with side flanges **20*a* and 20*b*. As shown in FIG. 3, before the carton is opened, the rear side of the tear strip 17 is joined to the front side of the front panel 18 at several spots with paste 19**.

The carton 11 contains a film 30 wound on a core 22 into a roll. The film is made of, for example, synthetic resin such as vinylidene chloride copolymers, polyvinyl chloride or poly-butadiene.

A metal cutter 21 is mounted to a rear side of the end of the front flange 15. A tip of the cutter 21 is formed with a saw-tooth edge which is protruded from the end of the front flange 15. The saw-tooth edge of the cutter 21 is positioned behind the tear strip 17 in the unopened state in which the tear strip 17 is not removed as shown in FIGS. 1 and 3. The saw-tooth of the cutter 21 is exposed from the end of the front flange 15 in the opened state in which the tear strip 17 has been removed.

The line of perforation 16 formed between the front flange 15 and the tear strip 17 is of a V-shape. Accordingly, when the tear strip 17 is cut and removed from the line of perforation 16, the end of the front flange 15 is of a convex shape as shown in FIG. 2 and a peak C of the convex edge positioned at a substantially central portion thereof is disposed nearest to the front end **11*a* of the bottom panel of the carton. In the embodiment shown in FIGS. 1 and 2, since the line of perforation 16 is of V-shape, the shape of the end of the front flange 15 with the tear strip 17 removed is of V-shape. Since the cutter 21 is provided along the end of the front flange 15, teeth of the saw-tooth edge of the cutter 21 are arranged into the V-shape lined up along the end of the front flange 15. A tooth positioned at a turning point $C_0$ of the teeth of the saw-tooth edge is disposed nearest to the front end 11*a*** of the bottom panel.

Figure 5:
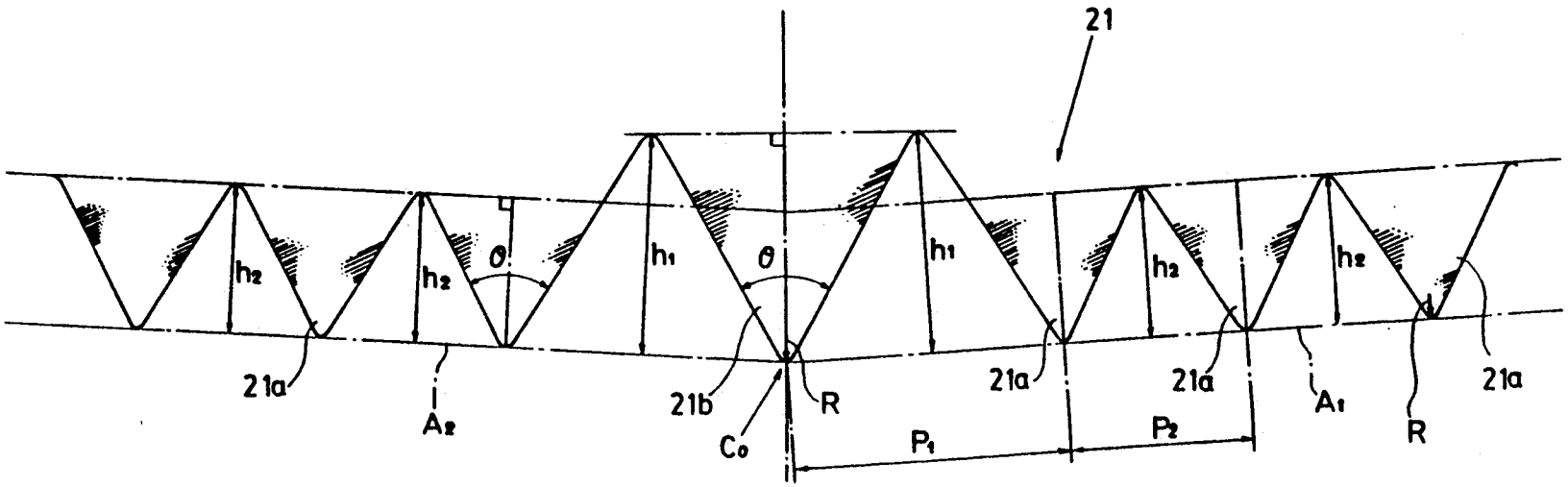
FIG. 5 is an enlarged front view of a center portion of one embodiment of cutting member provided in the dispensing carton.

As shown in FIG. 5 on the enlarged scale, the tooth **21*b* positioned at the turning point $C_0$ nearest to the front end 11*a* of the bottom panel of the carton 11 is larger than other teeth 21*a*. In the embodiment of FIG. 5, a depth $h_1$ of gullets adjacent to the tooth 21*b* at its both sides is formed larger than a depth $h_2$ of gullets between the other teeth 21*a*. An angle at the tip of the tooth 21*b* positioned at the turning point $C_0$ and the other teeth 21*a* is the same angle ($\theta$). Accordingly, a pitch $P_1$ between the tip of the tooth 21*b* positioned at the turning point $C_0$ and the tip of the teeth 21*a* adjacent to the tooth 21*b* is longer than a pitch $P_2$ between the tips of the other teeth 21*a*. thus, an area of the tooth 21*b* and a height from the tip thereof to the bottom of the gullet thereof are larger as compared with the other teeth 21*a*. However, the tip of the tooth 21*b* positioned at the turning point $C_0$ is positioned on phantom lines $A_1$ and $A_2$ connecting the tips of the other teeth 21*a*. In other words, the tips of all the teeth are positioned on the phantom lines $A_1$ and $A_2$ extending obliquely to the right and left of the tooth 21*b* and the tip of the tooth 21*b* at the turning point $C_0$ is positioned at an intersecting point of the phantom lines $A_1$ and $A_2$. In the embodiment, since the teeth of the cutter 21 are arranged into V-shape and the tooth 21*b* positioned at the turning point $C_0$ is larger than the other teeth 21*a*, the tooth 21*b* can cut into the film so that the film can be cut with smaller force as compared with a force required to cut the film in the conventional dispensing carton for a roll film. Accordingly, it is not necessary to make small the radius of curvature R of the tips of the teeth 21*a* and 21*b* to make sharp the edge of the teeth and even if the radius of curvature R is made larger and the edge of the teeth 21*a* and 21*b*** is made blunt, the film can be cut sufficiently. The blunt edge can ensure the safety for the user as compared with the conventional dispensing carton.

As shown in FIG. 2, a resinous tape **18*a* is affixed on the upper middle surface of the front panel 18 of the dispensing carton 11. The wrapping film left in the carton 11 after pulled out from the carton 11 and cut by the cutter 21 adheres closely to the tape 18*a* and is retained between the front panel 18 and the front flange 15 to prevent the remaining film from being wound back into the carton 11**.

The usage of the dispensing carton according to the embodiment is now described, using the X, Y and Z axes of the rectangular coordinates. The X-axis is a perpendicular axis to the rear panel 13 and the front panel 18 and the direction extending from the rear panel 13 to the front panel 18 is the positive direction of the X-axis while the direction extending from the front panel 18 to the rear panel 13 is the negative direction of the X-axis. The Y-axis is a perpendicular axis to the side panels 28 and 29 and the direction extending from the side panel 28 to the side panel 29 is the positive direction while the direction extending from the side panel 29 to the side panel 28 is the negative direction. The Z-axis is a perpendicular axis to both of the X- and Y-axes and the direction extending from the bottom panel to the opening 12 is the positive direction while the direction extending from the opening 12 to the bottom panel is the negative direction.

Thus, the usage of the dispensing carton according to the present invention is described with the X, Y and Z axes overlapped thereon.

Figure 6:
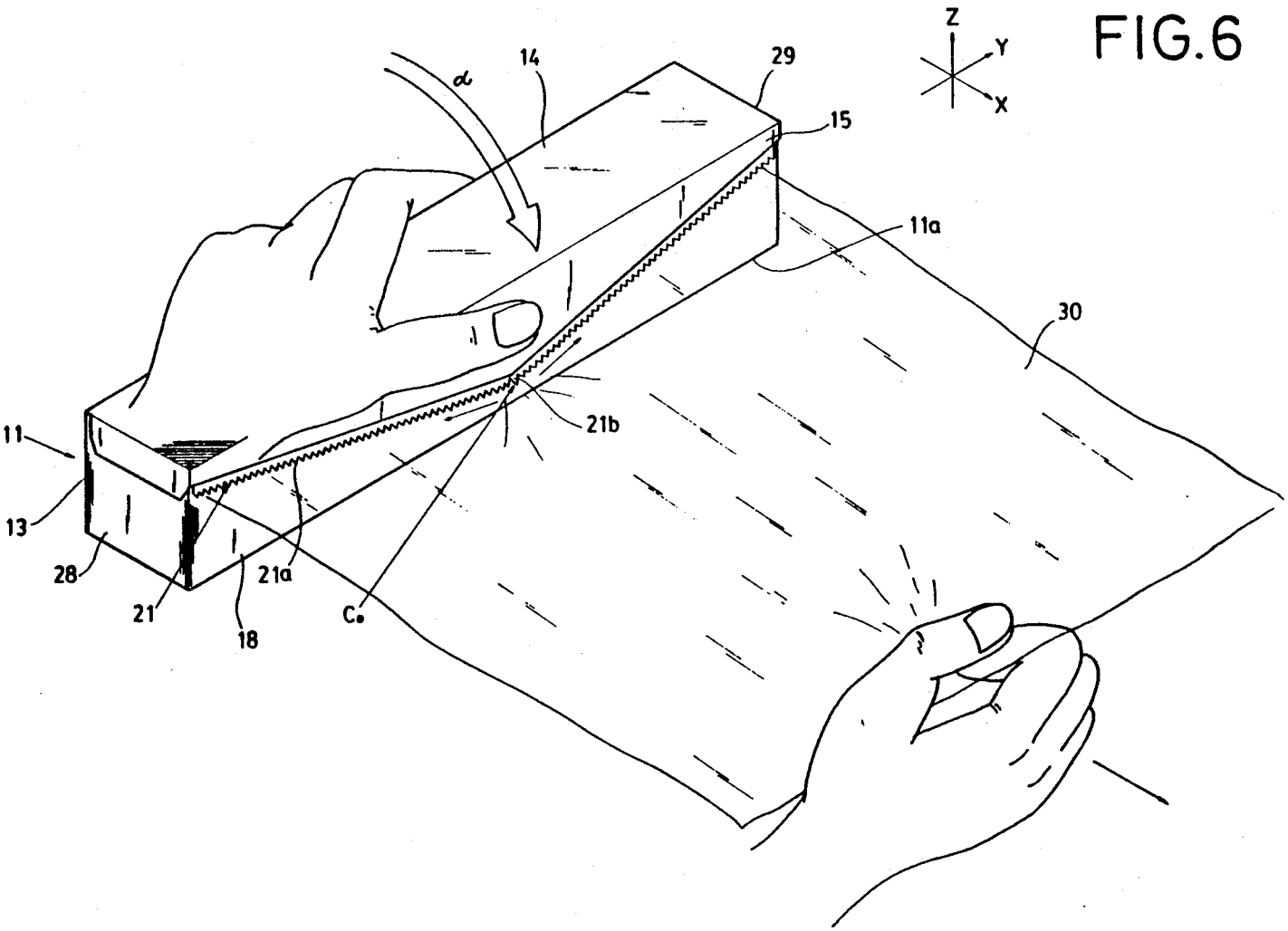
FIG. 6 is a perspective view showing a dispensing carton from which a film is pulled out to be cut.

When the carton is opened, the tear strip 17 joined to the front panel 18 of the carton 11 is stripped off and separated from the front flange 15 along the perforation line 16. When the tear strip 17 has been removed, the end of the front flange 15 is of V-shape as shown in FIGS. 2 and 6 and the saw-tooth edge of the cutter 21 is exposed along the front end of the front flange 15 as shown in FIG. 2. After the removal of the tear strip 17, the upper end 13*a* of the rear panel 13 of the carton 11 serves as a hinge so that the lid member 14 and the front flange 15 can be opened and closed with respect to the opening 12 of the carton 11.

Figure 4:
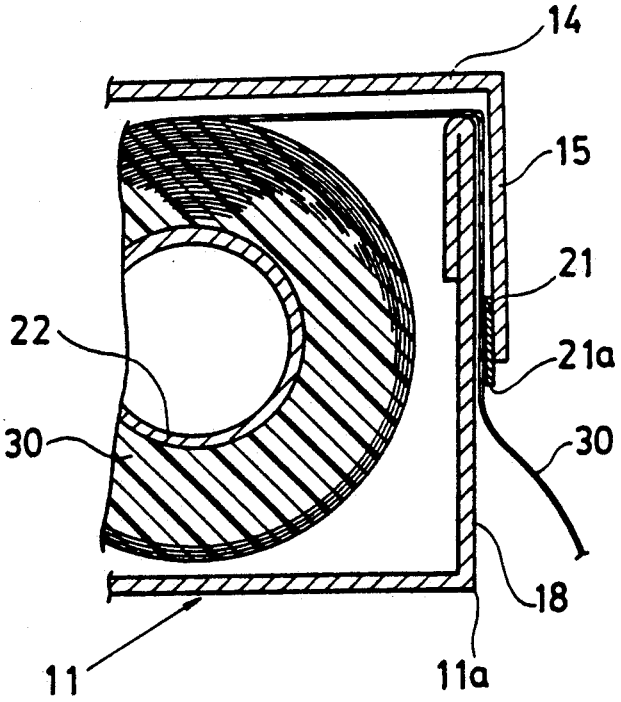
FIG. 4 is a sectional view showing a dispensing carton which has been opened and including a lid member which is closed.

After the tear strip 17 has been removed and the carton has been opened, the wrapping film 30 wound on the core 22 is pulled out from between the front panel 18 and the front flange 15 as shown in FIG. 4. After the film 30 has been pulled out by a desired length, the dispensing carton 11 is held by the left hand and the front flange 15 or the lid member 14 is held by the thumb, for example, as shown in FIG. 6. Further, the film 30 is held at the central tip thereof by the right hand. As described above, the end of the front flange 15 is formed into the V-shape and the teeth of the cutter 21 protruded from the end of the front flange are also arranged into the V-shape, of which the substantially central portion is the turning point $C_0$. Further, the tooth 21*b* positioned at the turning point $C_0$ is substantially larger than the other teeth 21*a* and the pitch $P_1$ between the tips of the tooth 21*b* and the right and left teeth 21*a* adjacent to the tooth 21*b* is also larger than the pitch $P_2$ between the tips of the other teeth 21*a*. With such a saw-tooth edge having the special shape as described above, when the center portion of the film 30 is pulled in the positive direction of the X-axis (+X) or pulled while being slightly lifted in the positive direction of the Z-axis (+Z), the tooth 21*b* positioned at the turning point $C_0$ cuts into the center portion of the film. Then, when the film 30 is further pulled, the cut line CL (FIG. 7) formed in the center portion of the film by the tooth 21*b* extends along the arrangement of the teeth 21*a* at both sides of the tooth 21*b* toward both side ends of the film so that the film 30 is cut smoothly and completely into V-shape. A method of cutting the film with the smallest force is that the film 30 is pulled in the positive direction of the X-axis (+X) by the right hand with a small force to tension the film and at the same time the wrist of the left hand holding the carton 11 is twisted slightly in the direction shown by arrow $\alpha$ in FIG. 6. The tooth 21*b* of the cutter 21 positioned at the turning point $C_0$ cuts into the center portion of the film 30 sharply by the twisting operation. Then, when the film 30 is further pulled in the positive direction of the X-axis (+X) by the right hand with small force as it is, the cut line CL (FIG. 7) formed in the center portion of the film 30 extends along the arrangement of the teeth 21*a* leftward and rightward, so that the film 30 is cut with small force smoothly and completely without wrinkle or intertwinement.

As described above, the film 30 can be cut exactly and completely by pulling the film from the carton 11 in the positive direction of the X-axis (+X) or slightly upward (in the positive direction of the Z-axis) or by twisting the carton 11 in the direction of arrow $\alpha$ while pulling the film 30 slightly in the positive direction of the X-axis (+X) and maintaining the film in the pulled state. Further, since it is not necessary to twist the film in the positive direction of the Z-axis (+Z) in order to cut the film 30, the film 30 is cut while fully spread substantially horizontally (in the X-Y plane). Accordingly, any wrinkle is not formed in the cut film or the film is not joined to each other with intertwinement. Thus, if the cut film 30 held by the right hand is lowered to an object to be wrapped such as foodstuffs and a tray as it is, the cut film 30 which has been spread substantially horizontally (in the X-Y plane) with a sufficient area is put on the object.

Figure 7:
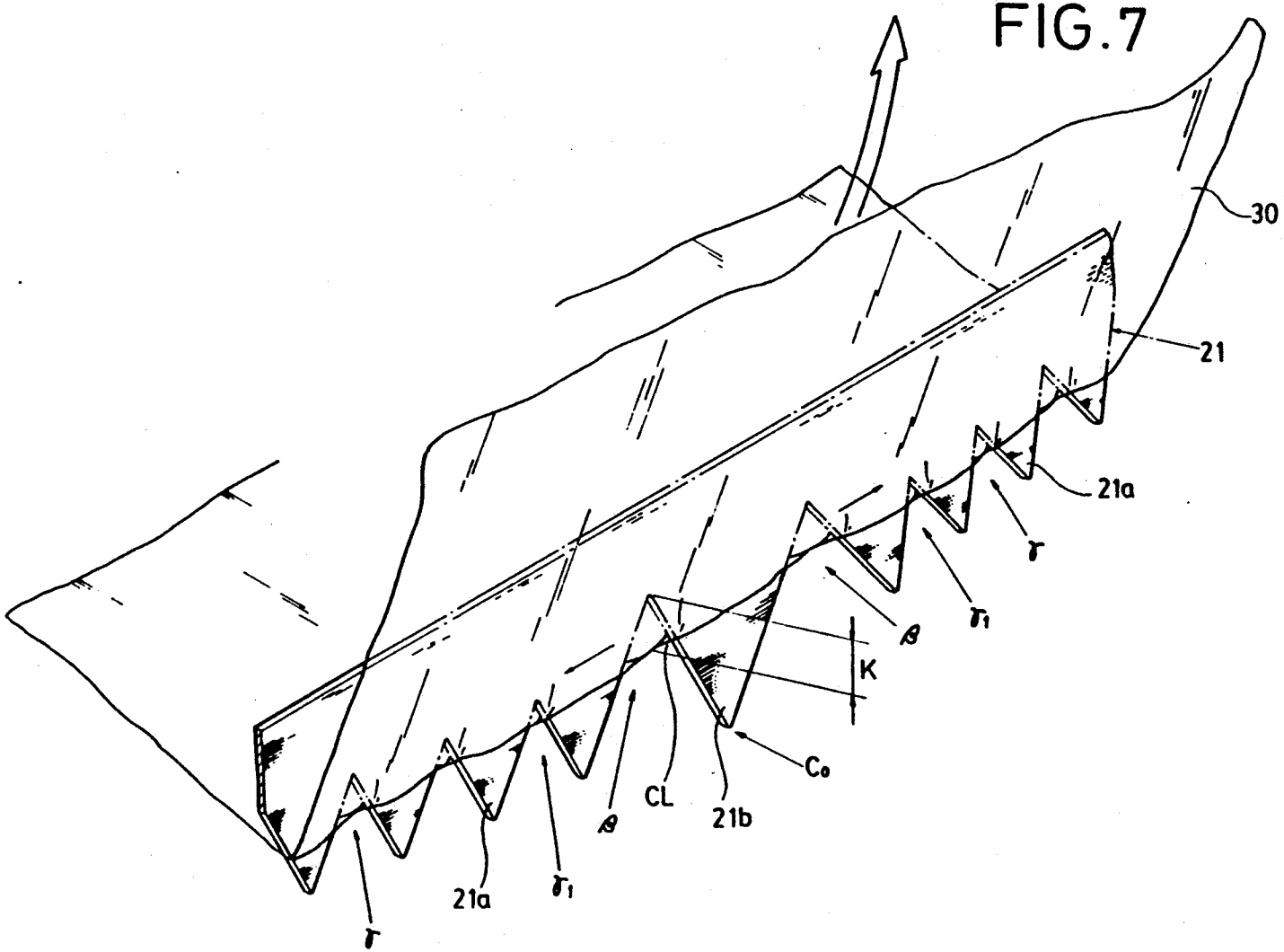
FIG. 7 is an enlarged perspective view of a saw-tooth edge of a cutting member which cuts into a film when a dispensing carton is twisted.

As described above, in the embodiment, since the tooth 21*b* of the cutter 21 positioned at the turning point $C_0$ is larger than the other teeth 21*a*, the tooth 21*b* tends to cut into the center portion of the film 30. FIG. 7 shows the tooth 21*b* positioned at the turning point $C_0$ and which cuts into the center portion of the film 30. Further, FIG. 7 shows the cutting operation in the case where the carton 11 is twisted in the direction of $\alpha$. It is a matter of course that the cutting state is the same as that of FIG. 6 even when the film 30 is merely pulled by the right hand in the positive direction of the X-axis (+X) or slightly upward (in the positive direction of the Z-axis) without twisting the carton 11. Since the tooth 21*b* is positioned at the turning point $C_0$ and is nearest to the front end 11*a* of the bottom panel as compared with the other teeth, the tooth 21*b* first cuts into the film. Further, the gullets (shown by $\beta$ in FIG. 7) adjacent to the tooth 21*b* at the right and left sides thereof are deeper than the gullets ($\gamma$, $\gamma_1$) between the other teeth 21*a*. Accordingly, when the saw-tooth edge cuts into the film by the mutual force applied to the film 30 and the carton 11 and the film 30 reaches the bottom of the gullet $\gamma_1$, there is a margin K between the film and the bottom of the deepest gullets $\beta$. Accordingly, force is then applied to the film so that the film can be further cut by both edges of the tooth 21*b* by the margin K. Thus, the cut line CL formed by the tooth 21*b* positioned at the turning point $C_0$ is further extended. The cut line CL tends to be extended along the arrangement of the teeth rightward and leftward in response to the extension of the cut line CL, so that the film can be cut with small force.

In the saw-tooth edge shown in FIG. 5, the tip of the tooth 21*b* is positioned on the phantom lines $A_1$ and $A_2$ connecting the tips of the other teeth 21*a* and is not protruded from the line $A_1$ and $A_2$. Accordingly, even if the hand comes into contact with the saw-tooth edge, the hand is safe.

Figure 8:
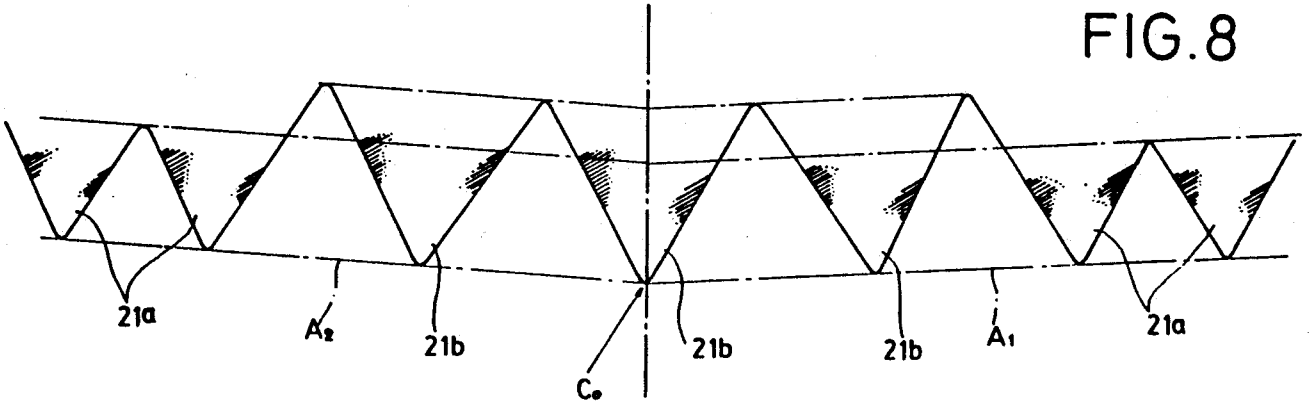
FIG. 8 is an enlarged front view of a center portion of a cutting member provided in a dispensing carton according to another embodiment of the present invention.

In an embodiment shown in FIG. 8, gullets disposed at both sides of three teeth 21*b* of the cutter 21 including the tooth thereof positioned at the turning point $C_0$ as well as right and left teeth adjacent thereto are deeper than gullets between teeth 21*a* except the three teeth 21*b*. Accordingly, all of the three teeth 21*b* are larger than the other teeth 21*a*. Further, in the embodiment, the tips of all of the teeth 21*a* and 21*b* are positioned on the common phantom line $A_1$ or $A_2$. In the cutting operation of the film, the three teeth 21*b* cut into the film to make the cut line CL in the center portion of the film 30.

Figure 9:
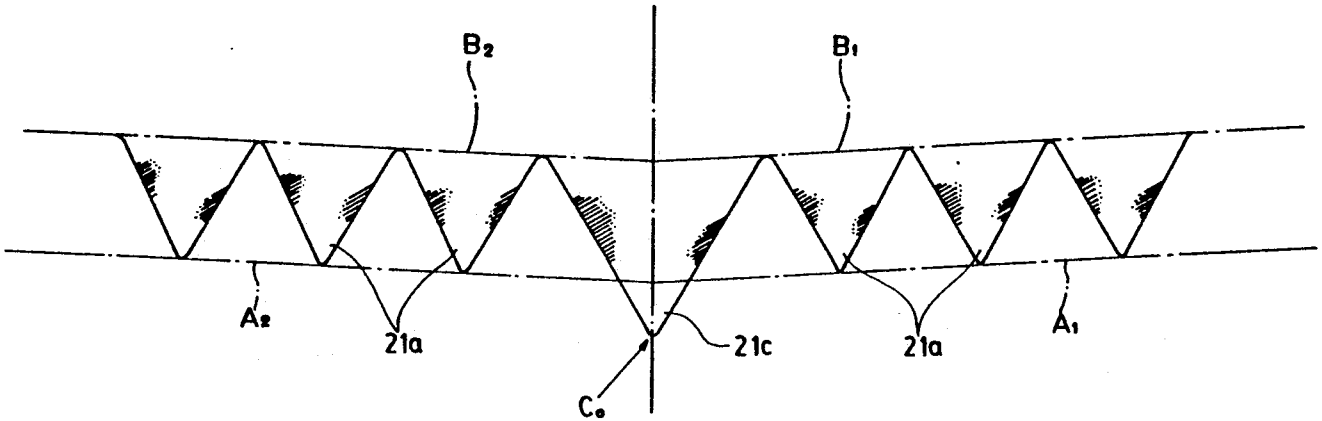
FIG. 9 is an enlarged front view of a center portion of a cutting member provided in a dispensing carton according to a further embodiment of the present invention.

In a further embodiment shown in FIG. 9, the tip of a tooth 21*c* of the cutter 21 positioned at the turning point $C_0$ is protruded from the phantom lines $A_1$ and $A_2$ connecting the tips of other teeth 21*a*. The bottoms of gullets between all teeth 21*a* and 21*b* are positioned on a common phantom line ($B_1$ and $B_2$). Further, an area of the tooth 21*c* positioned at the turning point $C_0$ is larger than that of other teeth 21*a*. In this embodiment, since the tooth 21*c* positioned at the turning point $C_0$ is protruded toward the bottom panel as compared with the other teeth 21*a*, the protruded tooth 21*c* cuts into the film to make the cut line CL.

Figure 10:
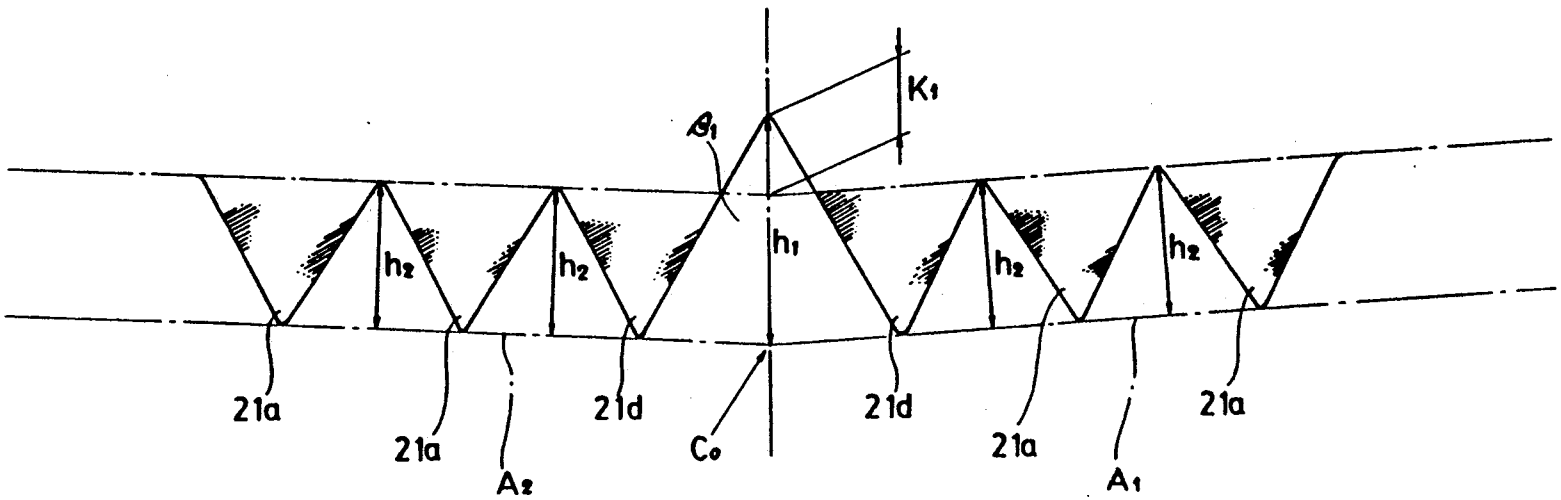
FIG. 10 is an enlarged front view of a center portion of a cutting member provided in a dispensing carton according to a still further embodiment of the present invention.
Figure 11:
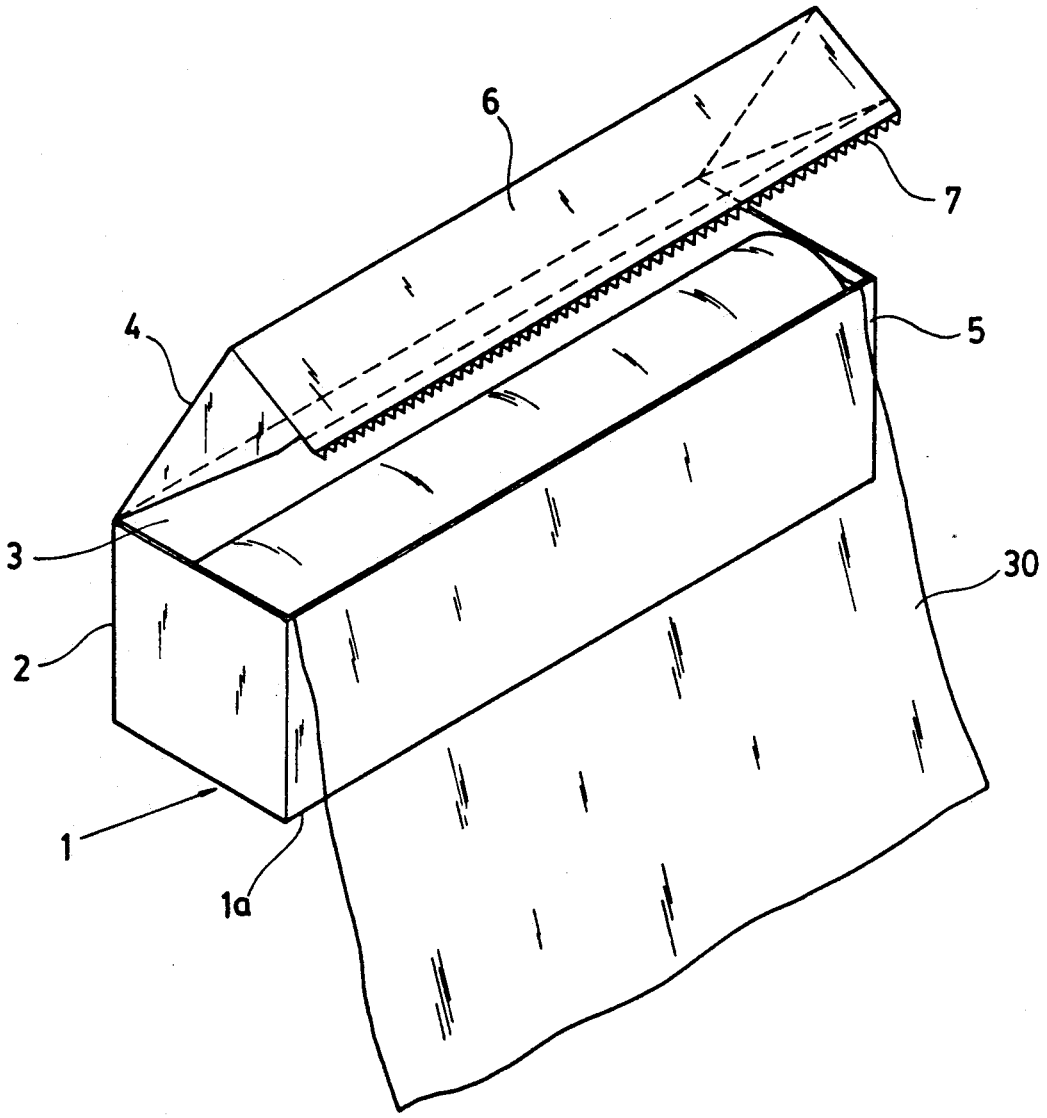
FIG.11 (Prior Art)
FIG. 11 is a perspective view showing a conventional dispensing carton for a roll film.
Figure 12:
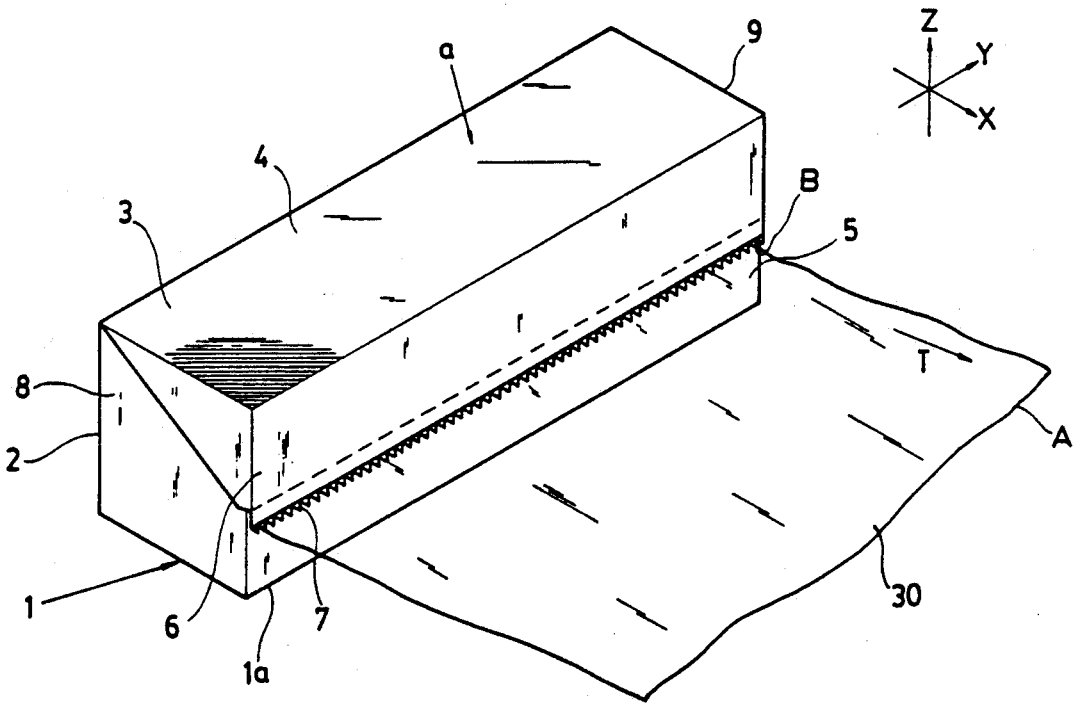
FIG.12 (Prior Art)
FIG. 12 is a perspective view illustrating a cutting operation of a film in a conventional dispensing carton for a roll film.

In a further embodiment shown in FIG. 10, any tooth is not positioned at the turning point $C_0$ of the cutter 21 and a gullet $\beta_1$ is positioned at the turning point $C_0$. The depth $h_1$ of the gullet $\beta_1$ is larger than the depth $h_2$ of the other gullets. All gullets other than the gullet $\beta_1$ have the same depth $h_2$. The tips of right and left teeth 21*d* adjacent to the gullet $\beta_1$ are positioned on the phantom line $A_1$ or $A_2$ connecting the tips of the other teeth 21*a*. In the embodiment, since the large gullet $\beta_1$ is formed at the turning point $C_0$, the teeth 21*d* adjacent to the gullet $\beta_1$ at both sides thereof easily cuts into the center portion of the film. More particularly, when the film 30 is cut, the difference $K_1$ between the depth $h_1$ of the gullet $\beta_1$ and the depth $h_2$ of the other gullets serves in the same manner as the margin K of FIG. 7 and the film is cut by the edges of the teeth 21*d* deeply by the margin $K_1$ so that the cut line serving as a first opening in cutting the film 30 is easily formed.

In the above embodiments, it is not necessary that the tooth 21*b* shown in FIG. 5, the central tooth 21*b* of the three teeth 21*b* shown in FIG. 8, the tooth 21*c* shown in FIG. 9, and the gullet $\beta_1$ shown in FIG. 10 are exactly positioned on the turning point $C_0$ and even if such a tooth or gullet is slightly deviated right or left from the turning point $C_0$, such a deviation is not departed from the sprit of the present invention.

In a further embodiment, a saw-tooth edge of the cutter may be formed with a tooth positioned at the turning point $C_0$ which includes the top protruded from the phantom lines $A_1$ and $A_2$ as shown in FIG. 9 and the gullets adjacent to both sides of the tooth and having the depth thereof deeper than that of the gullets between other teeth as shown in FIG. 5. Further, the saw-tooth edge of the cutter may be formed with two teeth 21*b* larger than other teeth as shown in FIG. 8 and disposed so that the turning point $C_0$ is disposed between the two larger teeth 21*b*.

Further, it is not necessary that the tip C of the front flange 15 and the turning point $C_0$ of the cutter 21 are positioned at the center thereof, and the tip C and the turning point $C_0$ may be positioned eccentrically rightward or leftward. The phantom lines $A_1$ and $A_2$ connecting the tips of the teeth are not required to be straight slant lines and may be a circular arc having a large curvature or another curve. In this case, however, the tooth 21*b* or 21*c* or the gullet $\beta_1$ shown in FIG. 10 is ideally disposed in the vicinity of the position on the curve nearest to the front end 11*a* of the bottom panel.

As described above, according to the present invention, the end of the front flange is of convex shape and the cutter is provided along the end of the front flange. The large tooth or gullet of the saw-tooth edge of the cutter is disposed at the position nearest to the bottom panel. Accordingly, the cutter easily cuts into the film in the cutting operation of the film. Thus, by pulling the film in the positive direction of the X-axis or slightly in the positive direction of the Z-axis or by twisting the carton in the clockwise direction while pulling the film, the film is smoothly and completely cut from the center portion to both ends thereof. Further, any wrinkle is not formed in the cut film and the cut film is not joined to each other with intertwinement so that the cut film which has been spread substantially in the X-Y plane is put on an object to be wrapped.

We claim:

1. A dispensing carton in which a film wound cylindrically is contained, comprising a box including a bottom panel, a rear panel, a front panel, both side panels and an opening formed in the upper portion of the front panel, a lid member which is hingedly joined to the rear panel, a front flange joined to an end of said lid member to overlap the front panel when said lid member is closed, said front flange having a convex edge which protrudes downwardly to a base of said box, a tear strip provided continuously on and integrally with an edge of said front flange with said tear strip separated from the front flange by a V-shaped perforation line, a cutting member provided on said V-shaped edge of said front flange and including a saw-tooth edge which is lined up along said V-shaped edge and said tear strip and said saw-tooth edge are arranged and configured such that when said tear strip is separated from said front flange, the teeth of said saw-tooth edge are exposed along said V-shaped edge of said flange, and wherein a length from a tip of a tooth of said saw-tooth edge at a turning point of said V-shaped edge to the bottom of a gullet adjacent to said tooth at said turning point is longer than a length from a tip of other teeth to the bottom of gullets adjacent to the other teeth, a distance from said tip of said tooth of said saw-tooth edge at a turning of said V-shaped edge to said tip of an adjacent tooth is longer than a distance between tips of said other teeth and said tip of said tooth at said turning point does not project beyond said tips of said other teeth along said V-shaped edge.

2. A dispensing carton according to claim 1 wherein said tip of said tooth at said turning point and a tip of each tooth located adjacent to and on each side of said tooth at said turning point is blunter than said tips of said other teeth.

3. A dispensing carton according to claim 2 wherein a tip angle of all teeth of said saw-tooth edge is substantially the same from the front flange by a convex perforation line and wherein said tear strip and said sawtooth edge are arranged and configured such that when said tear strip is separated from said front flange, the teeth of said sawtooth edge are exposed along said convex edge of said front flange.

4. A dispensing carton according to claim 3 further comprising a tear strip provided continuously on and integrally with an edge of said front flange with said tear strip separated from the front flange by a V-shaped perforation line and wherein said tear strip and said sawtooth edge are arranged and configured such that when said tear strip is separated from said front flange, the teeth of said saw tooth edge are exposed along said V-shaped edge of said front flange.

* * * * *